US009394091B2

(12) United States Patent
Writzl

(10) Patent No.: US 9,394,091 B2
(45) Date of Patent: Jul. 19, 2016

(54) METHOD FOR FASTENING WRAPPING SHEETS IN PULP-BALE PACKAGING, AND FASTENING ELEMENT

(75) Inventor: Walter Writzl, Graz (AT)

(73) Assignee: ANDRITZ AG, Graz (AT)

( * ) Notice: Subject to any disclaimer, the term of this patent is extended or adjusted under 35 U.S.C. 154(b) by 432 days.

(21) Appl. No.: 13/813,747

(22) PCT Filed: Jul. 20, 2011

(86) PCT No.: PCT/AT2011/000308

§ 371 (c)(1),
(2), (4) Date: Feb. 1, 2013

(87) PCT Pub. No.: WO2012/016256

PCT Pub. Date: Feb. 9, 2012

(65) Prior Publication Data

US 2013/0126376 A1 May 23, 2013

(30) Foreign Application Priority Data

Aug. 2, 2010 (AT) ..... 1294/2010

(51) Int. Cl.
*B65D 65/00* (2006.01)
*B65B 27/12* (2006.01)
(Continued)

(52) U.S. Cl.
CPC ..... *B65D 65/00* (2013.01); *B65B 27/125* (2013.01); *B65B 51/04* (2013.01); *B65D 65/46* (2013.01); *Y10S 411/905* (2013.01); *Y10T 24/1402* (2015.01); *Y10T 24/209* (2015.01)

(58) Field of Classification Search
CPC ..... B65D 65/38; B65D 65/46; B65D 65/466; B65D 27/125; B65D 65/00; Y10S 411/904; Y10S 411/905; Y10T 24/209
USPC ..... 24/17 R; 411/457, 458, 460, 920, 473
See application file for complete search history.

(56) References Cited

U.S. PATENT DOCUMENTS 2,110,734 A * 3/1938 Leslie ..... 411/457
3,792,563 A 2/1974 Mercer et al.
(Continued)

FOREIGN PATENT DOCUMENTS

WO 9110594 7/1991
WO 9300210 1/1993
(Continued)

OTHER PUBLICATIONS

International Search Reprot for PCT/AT2011/000308, English translation attached to original, Both completed by the European Patent Office on Oct. 24, 2011, All together 5 Pages.

*Primary Examiner* — Robert J Sandy
*Assistant Examiner* — Michael Lee
(74) *Attorney, Agent, or Firm* — Brooks Kushman P.C.

(57) ABSTRACT

A method for fastening wrapping sheets made of paper or cellulose in pulp-bale packaging, wherein a pulp bale is wrapped using a single-piece or two-part wrapping sheet made of paper or using a lower sheet and upper sheet made of cellulose. The method is characterized in that, at the location of overlap of the two paper or cellulose sheets, or at the end fold of the wrapping sheets made of cellulose or paper, one or more clip(s), including a decomposable material, not leaving behind any harmful components, as bale processing continues, is introduced into the bale. This makes it possible to avoid a costly binding machine or paper-strapping machine, and does away with the outlay required for disposing of the wire by the end user. A fastening device which includes a decomposable material which does not leave behind any harmful components, as bale processing continues is also disclosed.

5 Claims, 5 Drawing Sheets

Figure 1B:
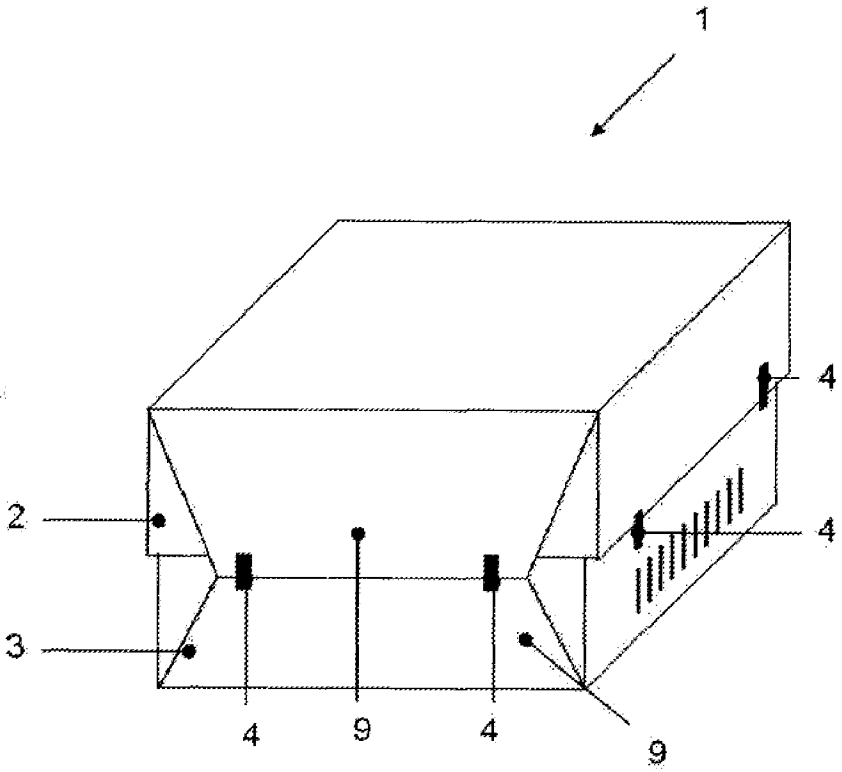

(51) Int. Cl.
*B65B 51/04* (2006.01)
*B65D 65/46* (2006.01)

(56) References Cited

U.S. PATENT DOCUMENTS 5,350,630 A 9/1994 Schreiner et al.
5,921,066 A 7/1999 Olsson et al.
6,394,727 B1 5/2002 Lundberg
2009/0266035 A1 10/2009 Dever et al.

FOREIGN PATENT DOCUMENTS

WO 9624524 8/1996
WO 9843877 10/1998

* cited by examiner

METHOD FOR FASTENING WRAPPING SHEETS IN PULP-BALE PACKAGING, AND FASTENING ELEMENT

CROSS-REFERENCE TO RELATED APPLICATION

This application is the U.S. national phase of PCT Appln. No. PCT/AT2011/000308 filed on Jul. 20, 2011, which claims priority to Austrian Patent Application No. A 1294/2010 filed on filed Aug. 2, 2010, the disclosures of which are incorporated in their entirety by reference herein.

The invention relates to a method for fastening wrapping sheets made from paper or cellulose in pulp-bale packaging, the pulp bales being wrapped either with a one-part or two-part wrapping sheet made from paper or with a lower and an upper sheet made from cellulose. The invention relates, further, to a fastening device.

For further processing in the bale line, these wrapping sheets have to be fastened in any way. This has been achieved hitherto by means of a variable number of steel wires which have been wound around each individual pulp bale. This method is costly, on the one hand because of the material costs for the binding wire and, on the other hand, because tying machines are additionally required. There are high costs incurred by the cellulose manufacturer for the binding wire and also incurred by the customer (paper manufacturer) for the removal and disposal of the wire. A further alternative method is strapping with paper tape, in which case, instead of wire, a paper tape is partially wound several times around the pulp bale and subsequently glued together.

Alternative methods are known, for example from WO 91/10594 or U.S. Pat. No. 3,792,563, cellulose packaging on the pulp bale being achieved here by gluing the sheets together. One problem in this case is that the adhesive, when dissolved, is a foreign substance which first has to be removed from the cellulose suspension produced. Further, some time elapses before the adhesive takes hold, thus leading to a lengthening of the packaging time or else to a reduction in the possible throughput rate.

The aim of the invention, therefore, is to achieve fastening of the pulp-bale packaging composed of cellulose or paper sheets without an additional machine, as, for example, in strapping with wire or paper tape, cost-effectively for the cellulose manufacturer and without additional costs and labor for the final customer (paper manufacturer).

The invention is therefore characterized in that one or more staples composed of a material which can be dissolved in the further bale processing process, without leaving harmful constituents behind, is or are introduced into the bale at the overlapping point of the two cellulose sheets or at the end fold of the wrapping sheets made from cellulose or paper, and in this case the staple material may be composed of paper tape or cellulose. Consequently, on the one hand, a cost-intensive tying machine or paper tape strapping machine and the running wire costs can be avoided, and also there is no outlay in terms of the disposal of the wire by the customer. A further advantage due to the invention arises from a low consumption of paper tape or cellulose strip, which, depending on the number of staples placed, corresponds approximately to 20-25% of what is necessary at the present time in the paper tape strapping method.

An advantageous further development of the invention is characterized in that the staple material is delivered in strip or tape form to a tool, and the tool can press the staple material through the, in particular, prepunched paper or cellulose sheets. A beneficial device which can operate virtually continuously is consequently provided.

A favorable refinement of the invention is characterized in that the tool forms a U-shaped staple, and in this case the staple can be folded back at its ends. As a result of the U-shape, the staple can easily be introduced between the cellulose sheets of the pulp bale, at the same time being fixed by the pressure of the cellulose sheets lying on top. Further, by the staple being folded back, additional safety against the release of the staple connection is achieved.

The invention relates, further, to a fastening device for fastening wrapping sheets made from paper or cellulose around pulp bales, which is characterized in that it is composed of a material which can be dissolved in the further bale processing process, without leaving harmful constituents behind, and in this case the fastening device may be composed of paper tape or cellulose. The fastening device therefore no longer has to be untied or have its wire removed by the customer, and, when cellulose is used, this can be manufactured beneficially in dedicated production by the cellulose manufacturer.

A favorable refinement of the invention is characterized in that it forms a staple which can be pushed in between the cellulose leaves of the pulp bale, and in this case it may be of U-shaped form and preferably be folded back at its ends. As a result of the U-shape, the legs can be pushed in between the stacked cellulose sheets in a simple way and be fixed by the pressure of the cellulose sheets lying on top. By the ends of the staple being folded back, additional safety against the release of the staple connection is achieved.

Figure 1A:
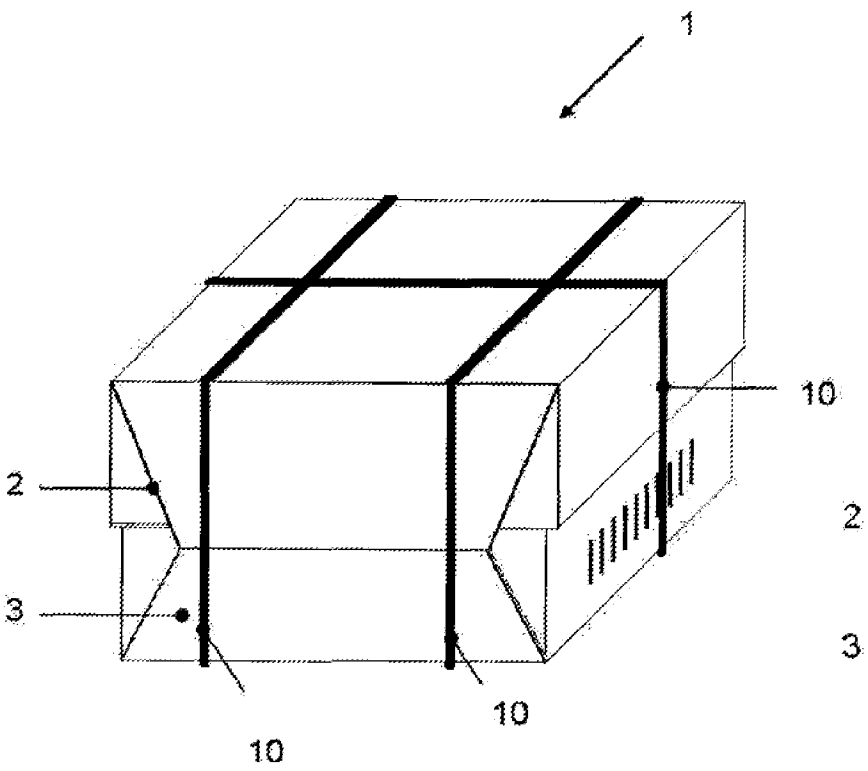
Figure 2B:
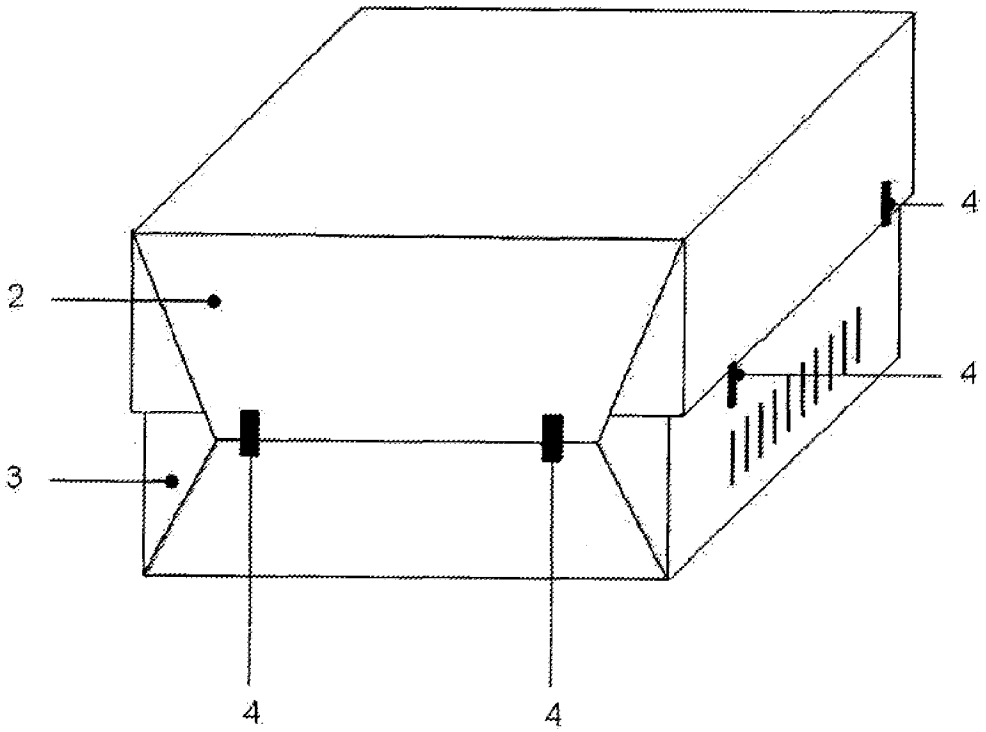
Figure 2A:
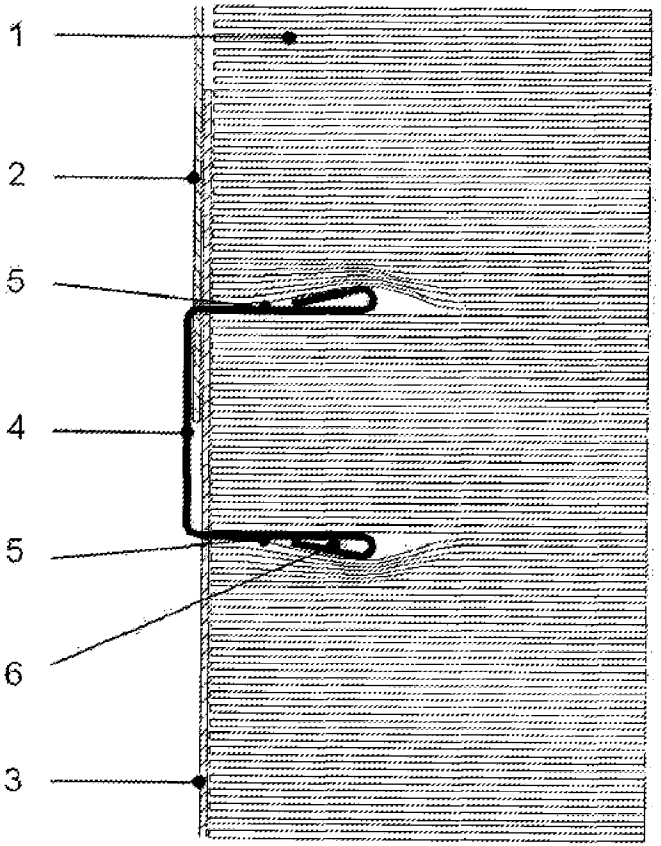

The invention, then, is described by way of example by means of the drawings in which FIG. 1*a* illustrates a view of a packaged pulp bale according to the prior art, FIG. 1*b* illustrates a view of a packaged pulp bale according to the invention, FIG. 2*a* illustrates a section through a pulp bale having a fastening device according to the invention, FIG. 2*b* illustrates a view of a packaged pulp bale, FIGS. 3*a* to 3*d* illustrate the individual method steps for introducing the fastening device, and FIGS. 4*a* to 4*d* illustrate various variants for the material of the fastening device.

FIG. 1*a* illustrates a view of a packaged pulp bale 1 according to the prior art.

This shows the variant with an upper cellulose sheet 2 and with a lower cellulose sheet 3 which overlap one another. The two cellulose sheets are fixed by means of a plurality of paper tapes 10.

By contrast, FIG. 1*b* shows a pulp bale 1 in which the cellulose sheets 2, 3 are fixed by means of staples 4. It can be seen clearly here that, as compared with the prior art, there is additionally a saving of paper tape or cellulose strip, the consumption of paper tape or cellulose strip corresponding to no more than approximately 20-25% of the variant according to the prior art. In winding around by means of a one-part wrapping sheet made from paper, only the end fold, that is to say the two flaps 9, would have to be fixed. FIG. 2*a* shows a ready-packaged pulp bale 1 (sectional illustration) as an example, with an upper cellulose sheet 2 and with a lower cellulose sheet 3 which overlap one another and, for further processing and transport, have to be fixed securely to the pulp bale. This takes place, according to the invention, by means of a fastening device which is designed here as a staple 4 with the legs 5 and with the folded-back ends 6. The two legs 5 of the staple 4 bent in a U-shaped manner and made from paper tape or cellulose are in this case pushed in between the stacked cellulose sheets and fixed by the pressure of the cellulose sheets lying on top. The folded-back ends 6 of the staple 4 achieve additional safety against the release of the staple connection. The number and position of the staple connections are freely selectable and can therefore be adapted in each case to the requirements of the bale packaging material and depending on the transport distance.

FIG. 2*b*, then, shows a ready-packaged pulp bale 1 with an upper cellulose sheet 2 and with a lower cellulose sheet 3 which overlap one another and are held together, safely for transport purposes, by a staple 4 made from paper tape or cellulose. The same applies similarly to winding around by a one-part or two-part wrapping sheet made from paper which is fixed at the end fold. The pulp bales thus secured can then be introduced by the final customer at the paper factory, without preliminary work and without residues, into a pulper and be opened up there. This does away with the previous cutting open and disposal of the wire rings, and as a result the risk of injury to the personnel when removing the wires manually is also avoided. Further, no wire remains which could possibly cause consequent damage (for example, screen damage) can infiltrate into the cellulose suspension.

Figure 3B:
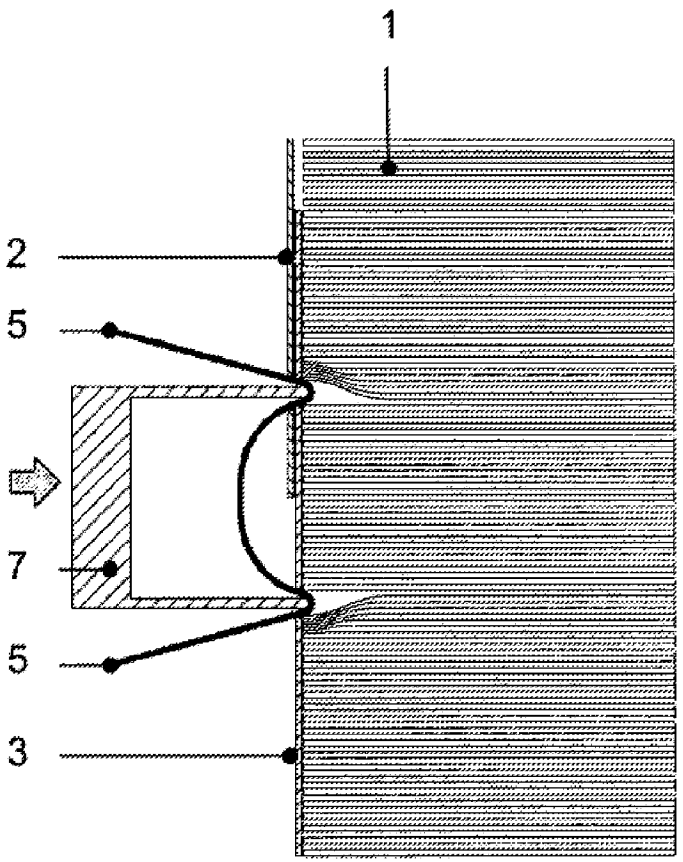
Figure 3A:
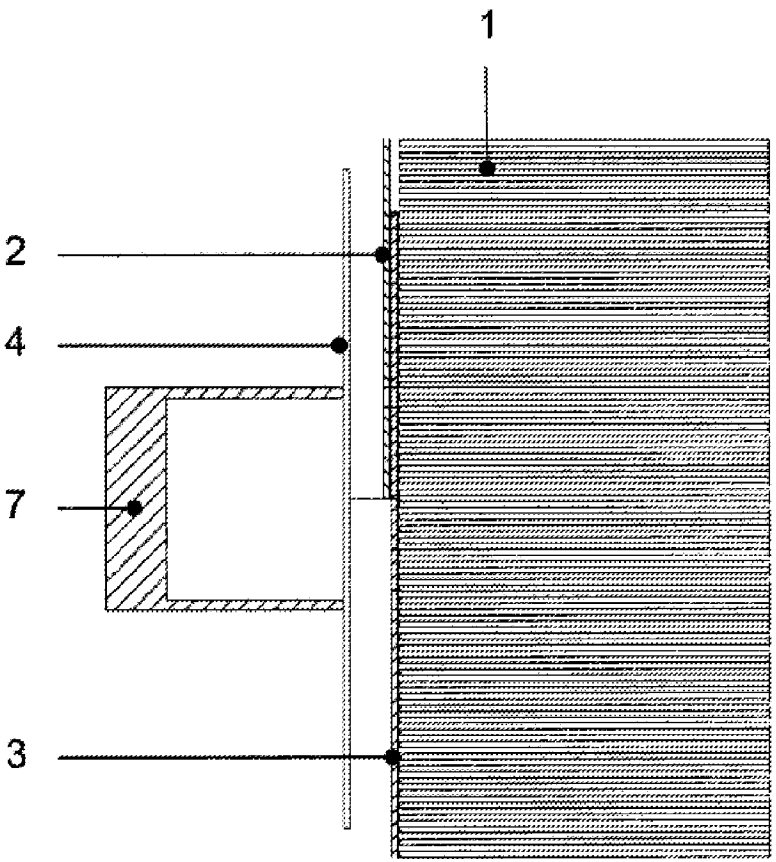
Figure 3D:
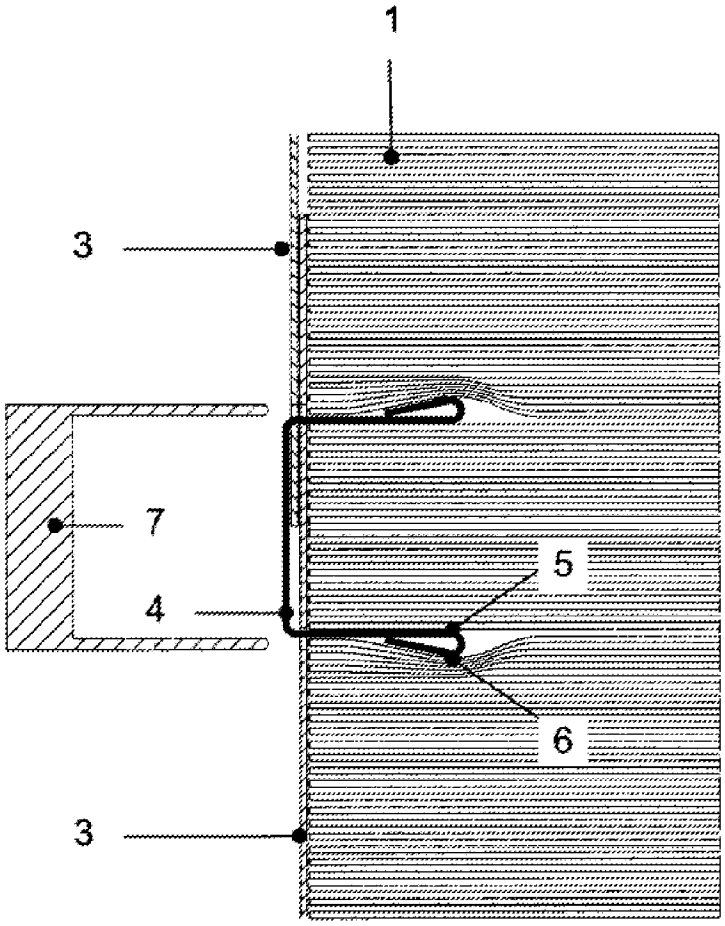

FIGS. 3*a* to 3*d* illustrate the individual method steps for introducing the fastening device 4 into the pulp bale 1. FIG. 3*a* shows here the initial position in which, for example, an upper cellulose sheet 2 and a lower cellulose sheet 3 overlap one another. The fastening device 4 is present here as a strip which, when appropriate, is unwound from a reel and cut off. The tool 7 for introducing the fastening device 4 into the pulp bale 1 is in its position of rest here. FIG. 3*b* illustrates how the tool 7 presses the staple material 4 through the packaging sheets 2, 3. The packaging sheets may in this case be already prepunched in order to make it easier to introduce the fastening device 4. The legs 5 which are formed can also be seen here. A possible prepunching device is not illustrated in the drawing here.

Figure 3C:
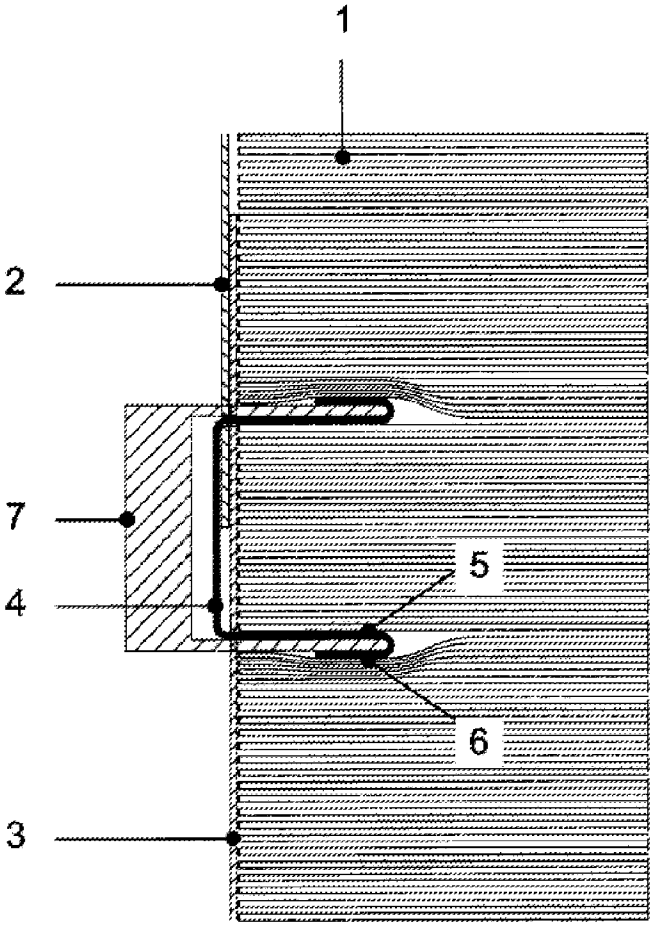

FIG. 3*c*, then, shows the end position of the tool 7 in the pulp bale 1. It can be seen here that folded-back ends 6 are formed. After the tool 7 has been pulled out (FIG. 3*d*), these folded-back ends 6 are pressed together somewhat by the load of the cellulose sheets located above and consequently additionally increase safety against the release of the staple connection.

Figure 4D:
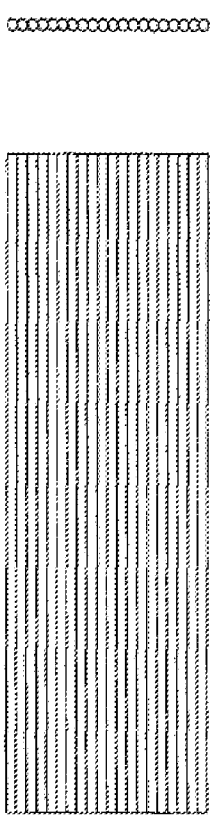
Figure 4C:
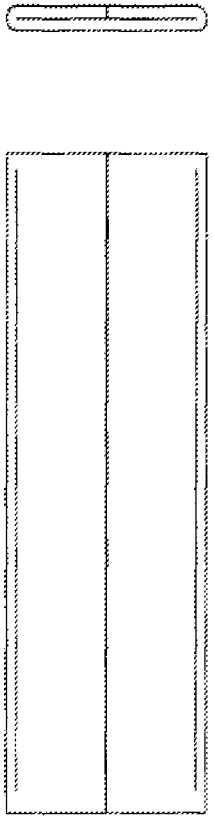
Figure 4B:
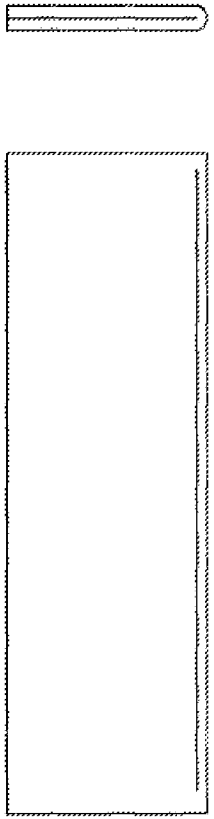
Figure 4A:
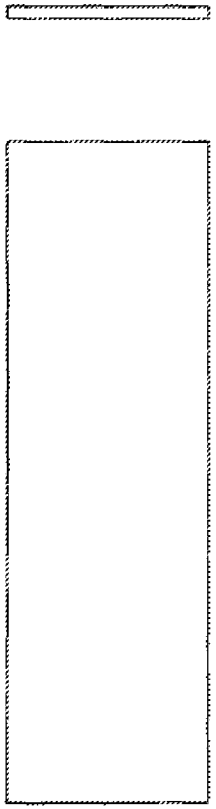

FIGS. 4*a* to 4*d* illustrate, respectively in a top view and in cross section, some examples of a number of various embodiments of cellulose or paper strips which can be used as a fastening device 4. FIG. 4*a* shows here a simple cellulose strip. FIG. 4*b* illustrates a double folded cellulose strip which has greater strength and therefore ensures greater packaging safety. FIG. 4*c* shows a folded paper strip, such as is also obtainable commercially. FIG. 4*d* then illustrates a twisted paper strip which is likewise commercially available. Further, all other commercially available paper tapes may also be used. The cellulose strips have the advantage that they can be made directly in the cellulose factory without high outlay and cost, whereas paper strips usually have to be purchased.

The invention claimed is:

1. A method for fastening wrapping sheets made from paper or cellulose in pulp-bale packaging, the method comprising:

wrapping a pulp bale formed by a plurality of stacked cellulose layers with a one-part or two-part wrapping sheet made from paper or with a lower sheet made from cellulose and an upper sheet made from cellulose, inserting one or more staples composed of a strip made from cellulose or paper into the bale at an overlapping point of the two paper or cellulose sheets or at an end fold of the wrapping sheets made from cellulose or paper, and delivering the one or more staples, each in an elongate strip or tape form, to a tool used to form and insert the one or more staples.

2. The method as claimed in claim 1, wherein the tool presses the staple material through, pre-punched holes in the wrapping sheets.

3. The method as claimed in claim 1, wherein during the inserting step the tool makes from the paper or cellulose strip a U-shaped staple by pushing ends of the U-shaped staple in between the stacked cellulose layers of the pulp-bale.

4. A method for fastening wrapping sheets made from paper or cellulose in pulp-bale packaging, the method comprising:

wrapping a pulp bale formed by a plurality of stacked cellulose layers with a one-part or two-part wrapping sheet made from paper or with a lower sheet made from cellulose and an upper sheet made from cellulose, delivering one or more staples of elongate strip or tape material made from cellulose or paper to a tool used to form and insert said one or more staples, and inserting one or more staples formed from the strip into the bale at an overlapping point of the two paper or cellulose sheets or at an end fold of the wrapping sheets made from cellulose or paper wherein during the inserting step the tool causes the paper or cellulose strip to form a U-shaped staple by pushing ends of the U-shaped staple in between the stacked cellulose layers of the pulp-bale, with the ends of the strip forming the staple folded back on themselves during the inserting step.

5. The method as claimed in claim 4, wherein the tool presses the staple material through, pre-punched holes in the wrapping sheets.

* * * * *